US006970568B1

(12) United States Patent
Freeman et al.

(10) Patent No.: US 6,970,568 B1
(45) Date of Patent: Nov. 29, 2005

(54) APPARATUS AND METHOD FOR ANALYZING AN ELECTRO-ACOUSTIC SYSTEM

(75) Inventors: Dwight H. Freeman, Edmonds, WA (US); Dennis Lynn Griffiths, Arlington, WA (US)

(73) Assignee: Electronic Engineering and Manufacturing Inc., Mountlake Terrace, WA (US)

( * ) Notice: Subject to any disclaimer, the term of this patent is extended or adjusted under 35 U.S.C. 154(b) by 0 days.

(21) Appl. No.: 09/406,203

(22) Filed: Sep. 27, 1999

(51) Int. Cl.[7] ..... H04R 29/00
(52) U.S. Cl. ..... 381/58; 381/59; 381/303
(58) Field of Search ..... 381/103, 303, 381/58, 59, 108

(56) References Cited

U.S. PATENT DOCUMENTS

| | | | | |
|---|---|---|---|---|
| 5,113,447 A | | 5/1992 | Hatley et al. | |
| 5,555,311 A | | 9/1996 | Reams | |
| 5,668,884 A | * | 9/1997 | Clair, Jr. et al. | 381/82 |
| 5,792,072 A | | 8/1998 | Keefe | |
| 5,825,894 A | | 10/1998 | Shennib | |
| 5,923,764 A | | 7/1999 | Shennib | |
| 6,167,138 A | | 12/2000 | Shennib | |
| 6,269,165 B1 | * | 7/2001 | Stott et al. | 381/93 |
| 6,389,111 B1 | | 5/2002 | Hollier et al. | |
| 6,639,989 B1 | * | 10/2003 | Zacharov et al. | 381/303 |

OTHER PUBLICATIONS

DRA Laboratories, "MLSSA Acoustical Measurement System," Brochure, www.mlssa.com, 8 Pages.
Rife, Douglas D., "MLSSA Maximum–Length Sequence System Analyzer", Reference Manual, Version 10WI–4, DRA Laboratories, Copyright 1987–2001, pp. i–296.

* cited by examiner

*Primary Examiner*—Ping Lee
(74) *Attorney, Agent, or Firm*—Dorsey & Whitney LLP

(57) ABSTRACT

An analysis system for accurately measuring the time-of-flight of an audio signal generated in response to a stimulus signal by an electro-acoustic transducer of an electro-acoustic system, such as an audio loudspeaker, to a point of measurement. The measurement is made by correlating the audio signal to a second signal having the same characteristics as the stimulus signal, but is delayed with respect to the stimulus signal. The measurement identifies the total overall delay from the time the stimulus signal is generated to the time the resulting audio signal is detected. Thus, any system delays, such as those due to signal processing, have already been accounted for by the measurement. Some or all of the measurement process may be automated through software programming in order to minimize measurement time. The time-of-flight is the delay time corresponding to when the stimulus signal, or the delayed second signal, and the resulting audio signal reach peak correlation. The distance of the acoustic center of the transducer can be calculated from the measured time-of-flight. The resulting comparison between the audio signal and the delayed second signal may also be used to determine the polarity of the transducer with respect to the stimulus signal.

67 Claims, 7 Drawing Sheets

APPARATUS AND METHOD FOR ANALYZING AN ELECTRO-ACOUSTIC SYSTEM

TECHNICAL FIELD

The present invention relates generally to audio test equipment, and more particularly, to a system and method for analyzing the distance of the acoustic center of an acoustic transducer and its polarity.

BACKGROUND OF THE INVENTION

Acoustic transducers of a conventional electro-acoustic system, such as loudspeakers, play a fundamental and significant role in an audience's listening experience. The loudspeakers are, in fact, the critical link between the electrical signal representing audio information and the resulting audio signal heard by the listener. Consequently, the performance of an electro-acoustic system may be severely limited by its loudspeakers. The loudspeakers of an electro-acoustic system must reproduce sound throughout the audio spectrum, which is typically considered to be from 20 Hz to 20,000 Hz. It is difficult for a single loudspeaker to accurately reproduce sound over the entire frequency range. Several loudspeakers are typically used in such a situation to provide adequate volume and coverage of the audio spectrum. Each loudspeaker is dedicated to reproducing sound for a particular frequency range, and the complement of loudspeakers are coordinated through a crossover network. However, electro-acoustic systems having multiple loudspeakers pose a particular challenge to the audio engineer.

In the case where the multiple loudspeakers are physically disassociated and may be placed at different positions throughout the listening area, the issue of time coherency between the audio signal generated by each loudspeaker becomes particularly significant. That is, the position of each loudspeaker relative to one another is related to the difference in time for the resulting audio signal produced by the respective loudspeaker to reach a particular point in the listening area. It is quite often the case where the poor quality of sound is not due to the quality of the loudspeaker itself, but is a result of the multiple loudspeakers not being aligned in time effectively for the majority of the audience. Thus, one of the goals of an acoustic engineer is to arrange and correct for the various positions of the loudspeakers of the electro-acoustic system in order to produce a coherent wavefront. The benefits of time correcting multiple loudspeakers located in acoustic space include minimized comb filtering, reduction of reverberant field, and increased intelligibility of the acoustic signal.

Practically speaking, it is often not possible to physically position multiple loudspeakers in relation to one another to produce a coherent wavefront. The positioning of loudspeakers may be limited by the physical space available for placement of the loudspeakers, as well as the size and shape of the listening area in which the loudspeakers are placed. To accommodate the various placement of loudspeakers in relation to one another, programmable electronic delay circuits have been used to correct for time disparities between the loudspeakers. The delay circuits may be programmed to delay the arrival of the stimulus signal to one loudspeaker, with respect to another loudspeaker, so that the difference in their relative position may be compensated by the programmed time delay. Thus, a more coherent wavefront of the resulting audio signal may be produced. However, in order for this method of time correction to produce sufficient results, it is necessary to determine the relative position of the multiple loudspeakers. The relative position of the multiple loudspeakers may be determined by the relative time delay of the acoustic signals of each loudspeaker.

One method of determining the relative time delay of the multiple loudspeakers is to physically measure the distance from each of the loudspeakers to a point located in the listening area. The relative time delay of each loudspeaker may be calculated from the resulting measurement, and used to program the appropriate delay times of the delay circuits. However, this method does not acknowledge the fact that the distance of each loudspeaker should be measured from its respective "acoustic center." The acoustic center of a loudspeaker is a term used to note the actual sonic origin of sound from the loudspeaker. The acoustic center is typically located further away than the loudspeaker itself. Thus, measuring the physical distance of the actual loudspeaker will not necessarily coincide with the physical distance of its acoustic center. In programming the delay times to produce a coherent wavefront, the distance should be measured from the acoustic center.

Further complicating the measurement is the fact that the acoustic center of a loudspeaker is frequency dependent. Due to the electro-mechanical nature of conventional loudspeakers, its acoustic center shifts depending on the frequency of the audio signal being produced. Consequently, the relative distances of multiple loudspeakers will change throughout the audio spectrum. Another factor that should be considered, but cannot be determined from physical measurement, is additional delay introduced by the electro-acoustic system itself, for example, digital signal processing of the stimulus signal prior to providing the resulting analog signal to the loudspeakers.

Another factor affecting the quality of sound the audience experiences is the polarity of a particular loudspeaker with respect to the stimulus signal, as well as to the other loudspeakers. The polarity of a loudspeaker is determined by its connection to the power amplifier of the electro-acoustic system. Two loudspeakers connected to have opposite polarities will produce audio signals 180 degrees out of phase. Consequently, the resulting audio signals may destructively interfere with one another and affect the overall sound quality. Determining the polarity of a particular loudspeaker by visually inspecting its connection to the power amplifier may not be practical if the loudspeaker is located in a position that is difficult to reach. For example, the speaker may be located high above the listening area, or may be mounted into a wall. In either case, visually inspecting the connection of the loudspeaker will not be easy.

There currently exists analysis equipment for evaluating various performance characteristics of an electro-acoustic system and its loudspeakers. One such system is described in U.S. Pat. No. 5,555,311 to Reams, issued Sep. 10, 1996. The system described in the Reams patent can determine, among other things, the bandwidth, the thermal limit, and the group delay of an electro-acoustic system. A Tef System and SIM System II are some additional examples of analysis equipment. These tools perform Fast Fourier Transforms on an impulse stimulus yielding a complete time and frequency analysis. Another measurement tool for loudspeaker evaluation and room acoustic which uses maximum length sequences is known as MLSSA. However, determining the time delay of the electro-acoustic system and its loudspeakers using these equipment involve interpreting data provided in a format more suited for discerning other measurement data. For example, measurement data may be provided in the form of a graphical representation of an impulse response. Determining the time delay involves interpreting the graphical information, which may require special training to understand the resulting measurement data. Furthermore, the existing analysis equipment often involve complicated and time-consuming setup procedures, which may also be carried out only by specially trained technicians.

SUMMARY OF THE INVENTION

The present invention is directed to a method and apparatus for measuring the time-of-flight of an audio signal generated in response to a stimulus signal by an electro-acoustic transducer, such as an audio loudspeaker, to a point of measurement by correlating the audio signal to a delayed signal having similar characteristics as the stimulus signal. The measurement identifies the total overall delay from the time the stimulus signal is generated to the time the resulting audio signal is detected. Thus, any system delays, such as those due to signal processing, have already been accounted for by the measurement. Some or all of the measurement process may be automated through software programming. The distance of the acoustic center of the transducer can be calculated from the measured time-of-flight. The resulting comparison between the audio signal and the delayed pseudo random noise signal may also be used to determine the polarity of the transducer with respect to the stimulus signal.

DETAILED DESCRIPTION OF THE INVENTION

Figure 1:
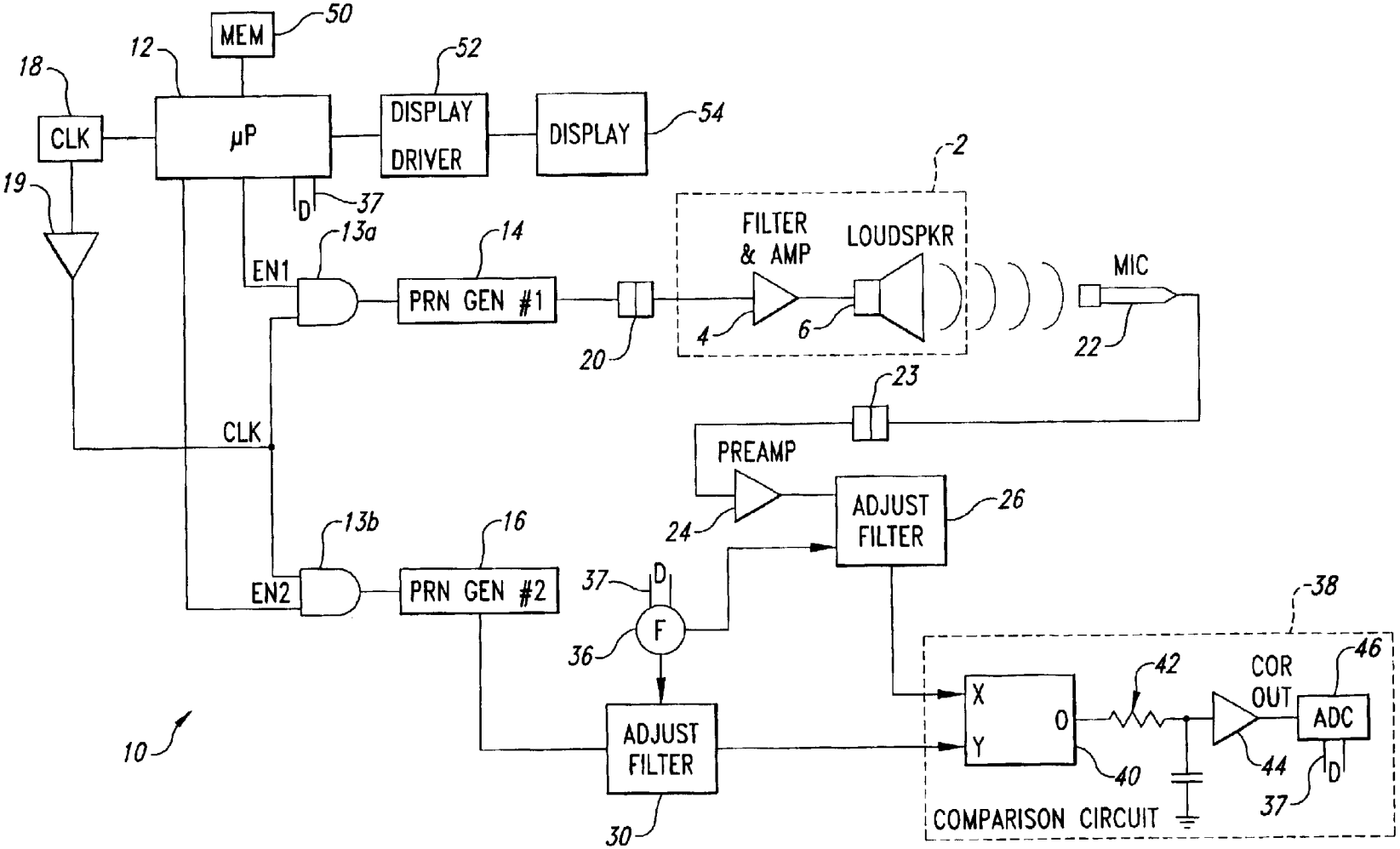
FIG. 1 is a block diagram of an analysis system according to an embodiment of the present invention.

Shown in FIG. 1 is an analysis system 10 according to an embodiment of the present invention. The analysis system 10 is coupled to a conventional electro-acoustic system 2, having a power amplifier 4 and an electro-acoustic transducer 6, such as an audio loudspeaker. The analysis system 10 measures the delay time for a stimulus signal applied to the electro-acoustic system 2 to be detected at a measurement point. The delay time is in turn used by the analysis system 10 to calculate the distance between the transducer 6 and the measurement point for a particular measurement frequency. The analysis system 10 may be programmed to automatically perform the measurement, or the measurement may be manually performed by an operator.

Various signals may be used for the stimulus signal. Generally, the stimulus signal should have unique characteristics so that a delay time may be determined from correlating the audio signal generated in response to the stimulus signal with a delayed version of the stimulus signal. A signal such as a simple sine wave having a constant magnitude and period would not be appropriate. However, music signals, noise signals, and the like could be used as the stimulus signal of the analysis system 10. In the case where music is used as the stimulus signal, the analysis system 10 may perform the measurement in real-time. Accordingly, the present invention is not limited to the use of a particular stimulus signal. A preferred embodiment of the analysis system 10 uses pseudo-random pink noise as the stimulus signal. A signal is characterized as being pseudo-random when the random noise sequence can be repeated, provided the same seed value is used to begin the sequence. That is, the pseudo-random noise signal has a distinct, but repeatable pattern. As will be explained in greater detail below, a pseudo-random signal facilitates the use of two separate signal generators to provide the stimulus and delayed stimulus signals. A pseudo-random noise signal can be devised to cover all or any part of the audio spectrum. Thus, the frequency range of the noise signals may encompass the bandwidth of the electro-acoustic system 2. The length of the pseudo-random sequence will be greater than the measurement time, and will consequently appear infinitely long to the electro-acoustic system 2.

The operation of the analysis system 10 is controlled by a conventional microprocessor 12. The microprocessor 12 provides activation signals through AND gates 13*a* and 13*b* to pseudo-random pink noise generators 14 and 16, respectively, to initiate a pseudo-random noise sequence. A clock circuit 18 provides through a buffer circuit 19 a clock signal that is used as the clock rate for the noise generators 14 and 16. The pseudo-random noise signal generated by the noise generator 14, NOISE1, is provided to a test signal connector 20. The electro-acoustic system 2 is connected to the test signal connector 20 to receive the NOISE1 signal as a stimulus signal. The audio signal generated by the transducer 6 in response to the NOISE1 signal is detected by a conventional microphone 22 coupled to the analysis system 10 through a connector 23. The resulting electrical signal output by the microphone 22 is applied to a band-pass filter 26 through a conventional preamplifier 24. Although the electro-acoustic system 2 is shown in FIG. 1 as having only one transducer 6, several transducers 6 may be included in such an electro-acoustic system 2. However, additional transducers 6 have been omitted from FIG. 1 in order to simplify explanation of the analysis system 10.

The noise generator 16 generates a noise signal, NOISE2, having the same pseudo-random sequence as the NOISE1 signal by using the same seed value to begin the NOISE2 sequence. As will be explained in greater detail below, the NOISE2 signal is initiated at a time after the NOISE1 signal is initiated. As explained below, the delay time of the NOISE2 signal with respect to the NOISE1 signal will be used by the analysis system 10 to determine the physical distance between the acoustic center of the transducer 6, at a particular frequency, and the microphone 22. The length of the delay time may be automatically adjusted by the analysis system 10, or manually adjusted by the operator making the measurement.

The NOISE2 signal is provided to a band-pass filter 30 having similar filter characteristics as the band-pass filter 26. The filter characteristics of filters 26 and 30 should be similar in order to maintain the phase and time relationship between the audio signal detected by the microphone 22 and the NOISE2 signal. Additionally, both the band-pass filters 26 and 30 have similar low-quality factors ("low-Q") in order to weight the frequencies near the band-pass frequency of the filters 26 and 30, while retaining the essential randomness of the signals being filtered. The band-pass frequency of both filters 26 and 30 are controlled by the frequency of a signal generated by a filter oscillator 36. The operating frequency of the oscillator 36 is controlled by the microprocessor 12 by data provided over a data bus 37. As will be explained below, the operating frequency, and consequently the band-pass frequency of filters 26 and 30, may be selected in order to facilitate measuring, at a particular frequency, the distance of a transducer of the electro-acoustic system 2, which may use multiple transducers to provide full coverage of the audio spectrum.

The output of filters 26 and 30 are provided to a comparison circuit 38. The comparison circuit 38 includes a conventional mixer 40, such as a four quadrant analog multiplier, coupled to receive the filtered signals of the band-pass filters 26 and 30. The mixer 40 compares the two filtered signals and generates a correlation signal having a magnitude indicative of the real time signed product of the two signals provided by the filters 26 and 30. The output of the mixer 40 is applied to a low-pass filter 42 in order to average the signed product output signals that occur wave by wave at audio frequencies in real time. The comparison circuit 38 further includes an analog-to-digital converter ("ADC") 46, that is coupled through a signal buffer 44 to the output of the low-pass filter 42. The ADC 46 is used to sample the output signal and provide digital data representing the value of the output signal to the microprocessor 12 on the data bus 37. As will be explained in greater detail below, the output of the low-pass filter 42 is sampled and averaged over a period of time to produce a signed average value indicative of the correlation between the audio signal produced by the transducer 6 and the NOISE2 signal. Generally, the signed average value of the mixer 40 is positive if the two signals are in time and have the same polarity, negative if the two signals are in time and have opposite polarities, and nearly zero if the two signals do not correlate.

A set of signed average values are generated for a range of delay times, and are stored with the associated delay times in a memory 50. The microprocessor 12 evaluates the stored data and determines the signed average value corresponding to the peak correlation between the audio signal produced by the transducer 6 and the NOISE2 signal. The delay time associated with the selected signed average value is used by the microprocessor 12 to calculate the physical distance between the acoustic center of the transducer 6 at the particular frequency and the microphone 22. The resulting distance value is provided by the microprocessor 12 to a conventional display driver 52 for displaying the results on a display 54.

The analysis system 10 also includes a number of other components and signal lines that have been omitted from FIG. 1 in the interests of brevity. For example, a digital-to-analog converter ("DAC") coupled to the microprocessor 12 provides the analog signal through a multiplexer (not shown) to the oscillator 36 to establish its operating frequency. The multiplexer is under the control of the microprocessor 12, and facilitates the use of the DAC for other control signals. An analysis system similar to the analysis system 10 is described in greater detail in the aforementioned Reams patent, which is incorporated herein by this reference.

Figure 2A:
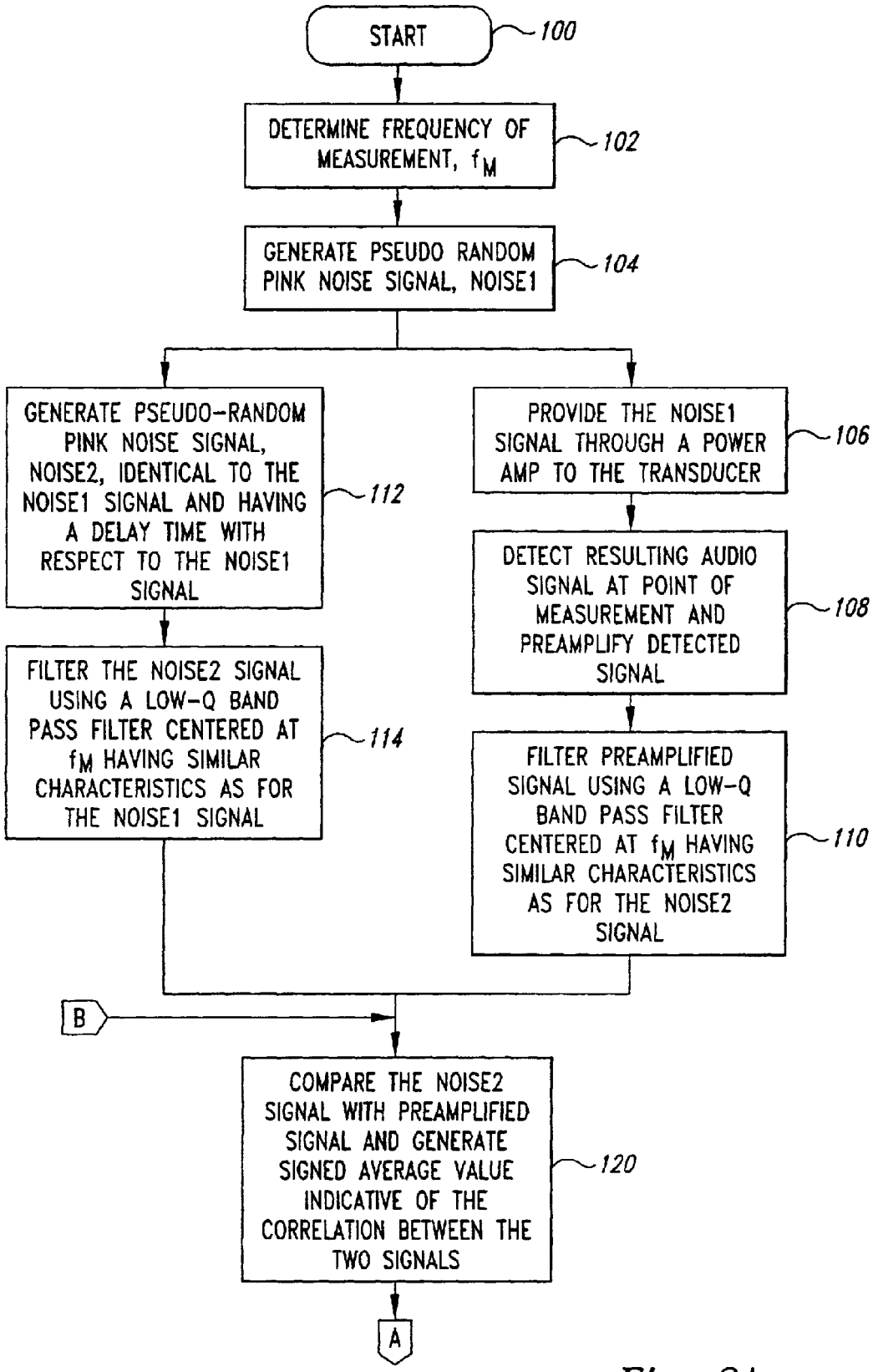
FIGS. 2A–B is a flowchart showing an operation of the analysis system of FIG. 1 for calculating the distance of the acoustic center of a electro-acoustic transducer according to an embodiment of the present invention.
Figure 2B:
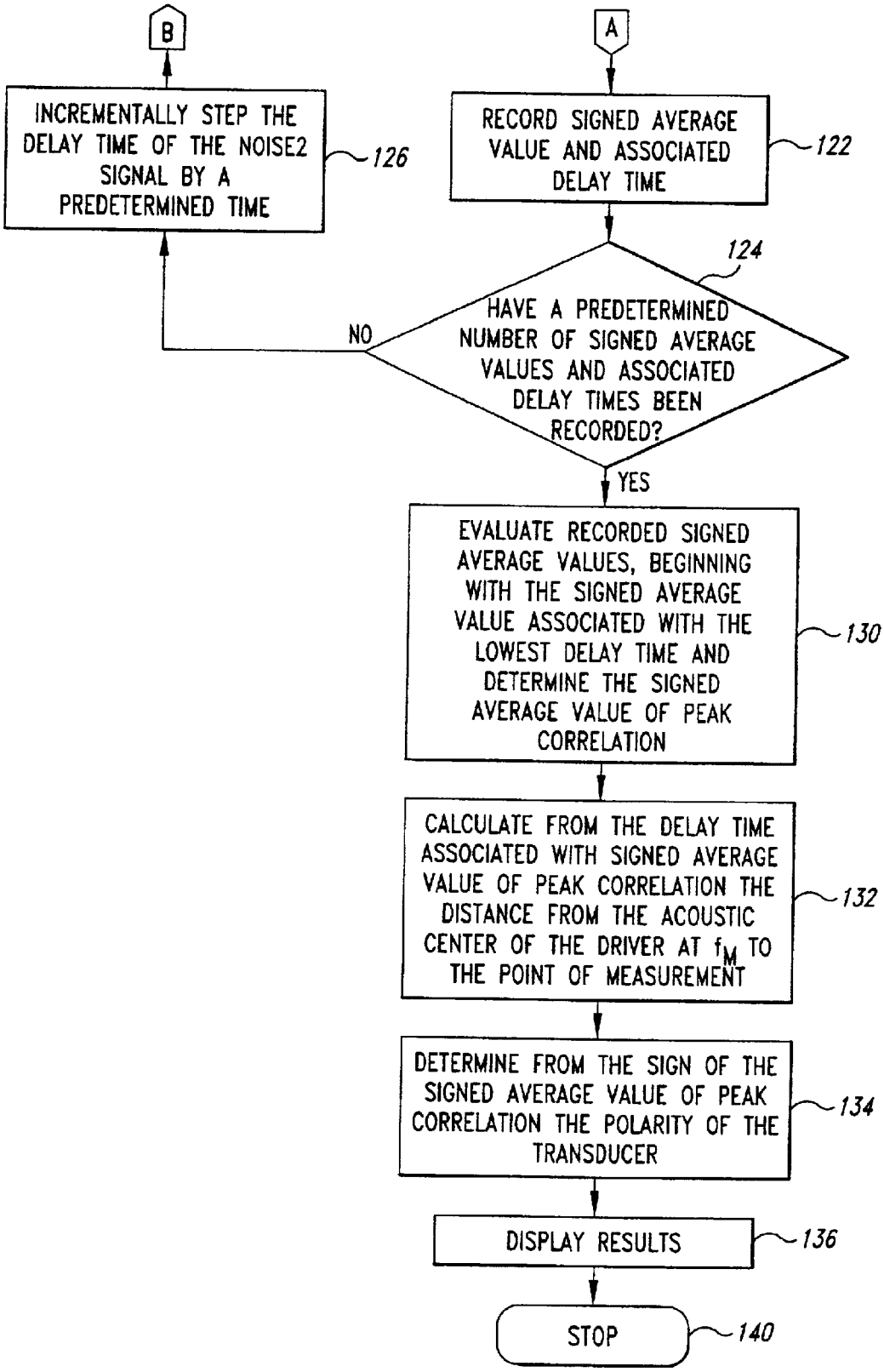

FIG. 2 illustrates the process by which the analysis system 10 can be employed to determine the delay time of a stimulus signal through the electro-acoustic system 2. As a matter of convenience in explaining the process illustrated in FIG. 2, the stimulus signal employed by the analysis system 10 is a pseudo-random pink noise signal. However, as mentioned previously, other signals, such as music, may be used as the stimulus signal as well. Based on the delay time determined by the analysis system 10, the physical distance from the acoustic center of the transducer 6 and a point of measurement may be calculated for a particular frequency. Some or all of the steps described herein may be automatically performed through software programming of the analysis system 10. Once the measurement equipment is in place, and the analysis system 10 is connected to the electro-acoustic system 2, such software programming facilitates automatic calculation of the physical distance of the acoustic center of the transducer 6. However, measurement using manual adjustments by the operator may be made available where such feature is desired.

Figure 3A:
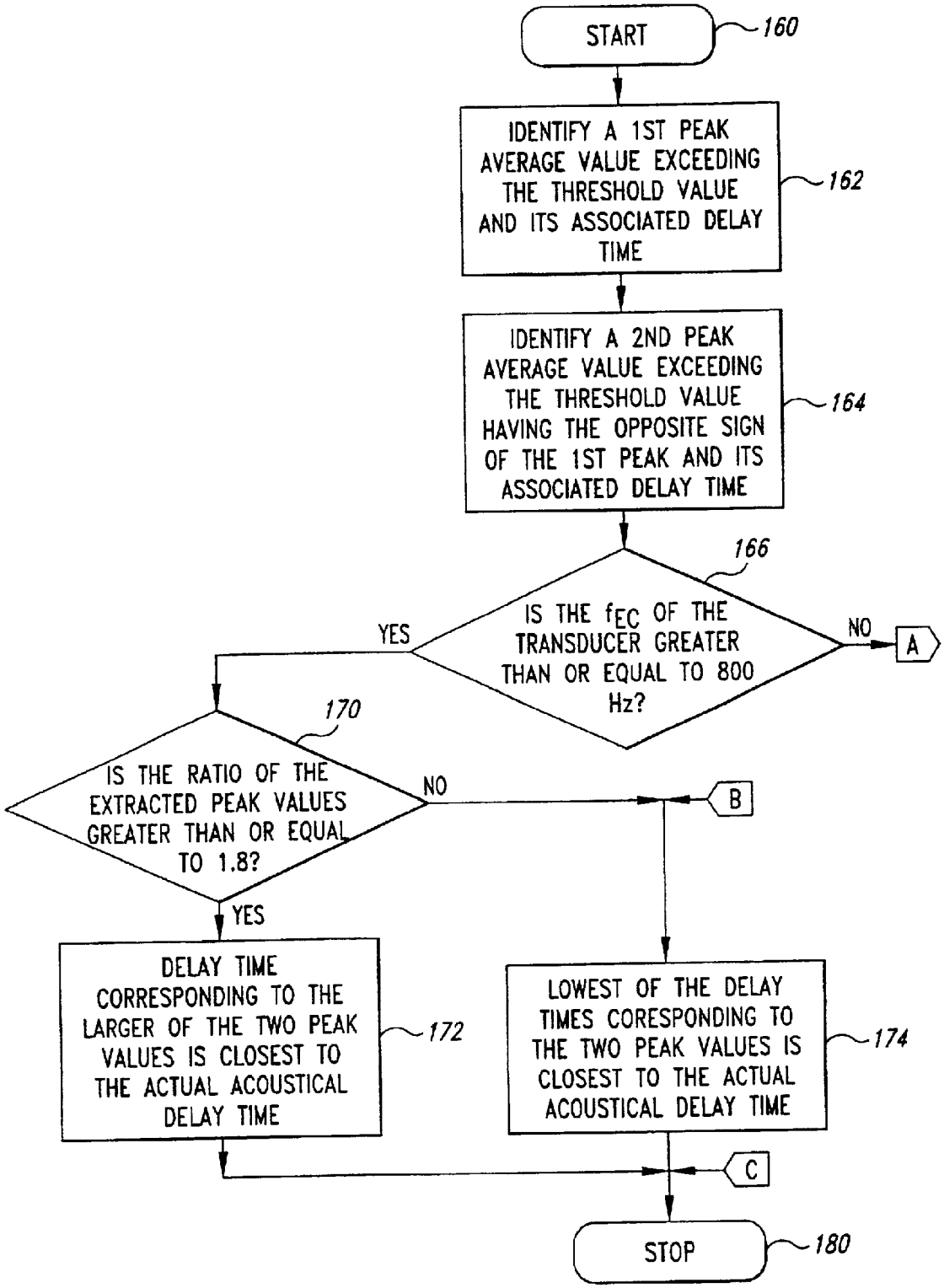
FIGS. 3A–B is a flowchart showing an operation that may be substituted into the operation shown in FIGS. 2A–B for determining the peak correlation according to an embodiment of the present invention.
Figure 3B:
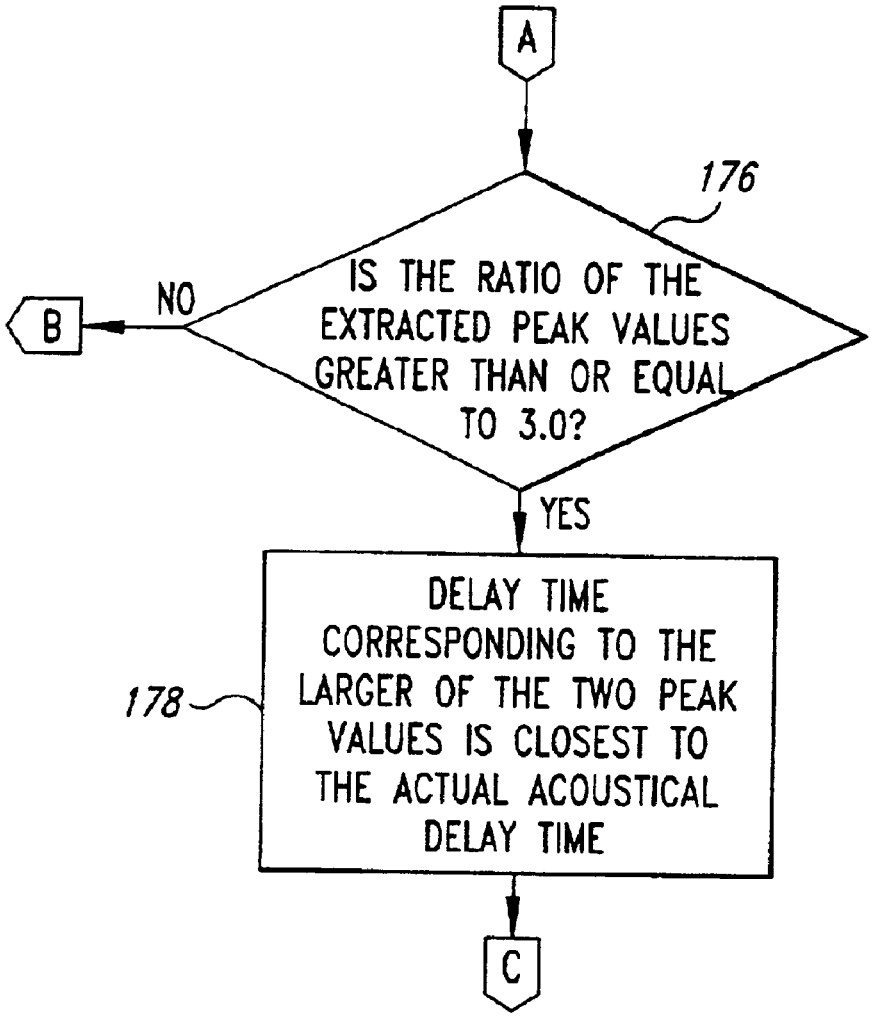

At a start 100, shown in FIG. 3, the analysis system 10 has been connected to the electro-acoustic system 2 by connecting the power amplifier 4 to the test signal connector 20 to receive the NOISE1 signal, and the microphone 22 connected to the connector 23 has been positioned at the point of measurement in the listening area. In step 102, a particular measurement frequency, $f_M$, is selected at which the delay time is determined. As a mentioned previously, the phase response of the conventional transducer 6 is dependent on frequency, and the acoustic center of the transducer 6 varies with the frequency of the signal being reproduced. Therefore, a particular measurement frequency should be selected in order to obtain relevant measurement data.

As mentioned previously, the measurement frequency should be selected so that when multiple transducers 6 are being used to provide full coverage of the audio spectrum, the delay time of a stimulus signal reproduced by a particular transducer may be measured. A suggested frequency at which to measure a particular electro-mechanical transducer is at its "energy center frequency," $f_{EC}$. This is defined as the frequency at which the transducer produces equal acoustic energy above and below the frequency over the 20 Hz-20 kHz frequency spectrum. Coincidentally, the particular transducer reproduces a signal having minimal phase error with respect to the input signal at the $f_{EC}$. However, while measuring at the $f_{EC}$ of a transducer is preferred, measurements may be made at other frequencies. For example, in an electro-acoustic system having separate loudspeakers for low, mid, and high frequencies, the desired $f_M$. may be selected at the crossover frequencies of the separate loudspeakers, or in the frequency region where the frequency overlaps. Choosing such an $f_M$ permits measurement of the overall delay, including phase shift introduced by the crossover.

The resulting measured time interval can then be used to accurately align the resulting audio signal in the portion of the frequency spectrum the separate loudspeakers are required to reproduce, namely, in the crossover region.

After the $f_M$ has been selected, in step 104 the microprocessor 12 initiates the noise generator 14 to begin generating a pseudo-random pink noise signal, NOISE1.

As discussed previously, the pseudo-random nature of the NOISE1 signal is characterized by a random sequence that may be reproduced, provided that an identical seed value is used to initiate the signal. The NOISE1 signal is provided to the input of the power amplifier 4 of the electro-acoustic system 2 as a stimulus signal to drive the transducer 6 in step 106. In step 108, the resulting audio signal produced by the transducer 6 is detected by the microphone 22 positioned at the point of measurement, and pre-amplified by the pre-amplifier 24 of the analysis system 10. Subsequently, in step 110, the pre-amplified signal is filtered through the low-Q band pass filter 26 having a band pass frequency, $f_C$, that is equal to the $f_M$. As mentioned previously, the low-Q nature of the bandpass filter provides for the weighting of the frequencies near the $f_M$ while still retaining the essential randomness of the noise signal.

From step 104, the analysis system 10 performs steps 112 and 114, which relate to a second pseudo-random noise signal generated by the noise generator 16, NOISE2. In step 112, generation of the NOISE2 signal is delayed with respect to the NOISE1 signal. The delay time selected should take into consideration the approximate time-of-flight of a signal produced by the transducer 6 and detected by the microphone 22 positioned at the point of measurement. The time-of-flight of an audio signal produced by the transducer 6 to the microphone 22 positioned at the point of measurement may be approximated by providing a sine ping as a stimulus signal to the electro-acoustic system 2. The analysis system 10 measures the time delay between generating the sine ping and receiving the resulting audio signal produced by the transducer 6 to determine the approximate time-of-flight. Such a technique can locate the acoustic center of the transducer 6 within a few wavelengths. This is sufficient for determining an appropriate initial delay time for the NOISE2 signal, however, the measurement lacks the desired accuracy necessary to produce a coherent wavefront in a multi-transducer system. Furthermore, the polarity of the transducer 6 cannot be determined using the aforementioned technique.

As will be explained in more detail below, a more accurate measurement of the distance will be determined by the analysis system 10, by correlating the audio signal produced by the transducer 6 and the NOISE2 signal over a range of delay times which includes the approximate time-of-flight. As a practical matter, in order to facilitate measurement, a suggested delay time at which to begin generating the NOISE2 signal is the sum of the approximate time-of-flight and 1.5 waveperiods at the $f_M$. That is, $$\text{delay time of noise signal } \mathbf{2} = (\text{approximate time-of-flight} + 1.5T_{fM})$$

Measurement of the approximate time-of-flight and selection of an initial delay time may be performed by the analysis system 10 via software programming in order to automate the delay time measurement.

A person of ordinary skill in the art will appreciate that generating the NOISE1 and NOISE2 signals may be implemented in a variety of ways. As illustrated in FIG. 1, the two separate pseudo-random pink noise generators 14 and 16 used to generate the NOISE1 and NOISE2 signals, respectively, are coupled to receive activation signals from the microprocessor 12. The activation signal initiating the noise generator 16 is delayed by the microprocessor 12 with respect to the activation signal initiating the noise generator 14. Thus, the delay time of the NOISE2 with respect to the NOISE1 signal is a result of the microprocessor 12 activating the second noise generator 16 at a time later than activating the first noise generator 14. However, the NOISE1 signal and the NOISE2 signal may also be produced using a single pseudo-random pink noise generator and a variable delay circuit (not shown) having a delay time automatically adjusted by the microprocessor 12, and additionally, or alternatively, manually adjusted by the operator. The output of the single noise generator is provided to the power amplifier 4 of the electro-acoustic system 2, as well as to the input of the variable delay circuit. The output of the variable delay circuit provides the NOISE2 signal. In this case, the delay time of the NOISE2 signal is a result of adding a delay time controlled by the microprocessor 12 to a common noise signal. The use of a single noise source and a microprocessor controlled variable delay circuit facilitates using music, live or recorded, as a stimulus signal. These examples are provided for the purposes of illustration, and, because various methods of producing a delayed noise signal with respect to another noise signal are well known in the art, are not meant to limit the scope of the present invention.

Subsequently, in step 114, the NOISE2 2 is filtered through the low-Q band pass filter 30 having its $_C$ equal to the $f_M$. As mentioned previously, the band pass filter 30 should have filter characteristics very similar to those of the band pass filter 26 used for the pre-amplified signal in order for the NOISE2 signal to have the same weighted frequency relationship as the pre-amplified signal.

The pre-amplified signal detected by the microphone 22 and the NOISE2 signal are compared in step 120 by providing each signal to the conventional mixer 40, such as a four-quadrant multiplier. The mixer 40 produces an output signal having a polarity and voltage value indicative of the product of the pre-amplified signal and the NOISE2 signal. As mentioned previously, the multiplier 40 will produce a positive output signal if the two signals being compared are in time and have the same polarity, and a negative output signal if the two signals are in time but have opposite polarities. Consequently, if the voltage value of output signal of the multiplier is sampled and converted from an analog to digital value over a predetermined length of time, the resulting signed average value will be indicative of the correlation between the two signals input to the mixer 40. If the two signals do not correlate, the output of the multiplier will average to nearly zero over the sample period. The resulting analog output of the mixer 40 is sampled and converting to digital values by the ADC 46. Analog-to-digital conversion is well known in the art, and will not be discussed in detail herein in the interest of brevity.

A person of ordinary skill in the art will appreciate that the output signal of the mixer 40 should be filtered by the low pass filter 42 to attenuate high frequency components of the output signal prior to sampling. Furthermore, sampling should not begin until there has been sufficient time for the output of the low-pass filter 42 to settle. Such details are within the knowledge of those ordinarily skilled in the art, and may be resolved without undue experimentation. Thus, discussion of such details have been omitted from herein.

As mentioned previously, a signed average value is generated by sampling the magnitude of the output signal of the mixer 40, and averaging the sampled values. Although the specific number of samples that should be made is not limited to a specific number, it has been determined that making 128 samples at 20 ms intervals provides sufficient data to produce a signed average value that is indicative of the correlation of the pre-amplified signal and the NOISE2 signal. However, as a person of ordinary skill in the art will appreciate, the number of samples taken, and the samples rate may be increased or decreased, depending on the accuracy and measurement time desired, and the stimulus signal used by the analysis system 10. That is, other types of stimulus signals may need more samples to be taken in order to obtain accurate results.

As will be explained in greater detail below, a resulting signed average value is determined for a series of delay times which includes the approximate time-of-flight. That is, for each delay time there will be an associated signed average value that is indicative of the level of correlation at that delay time. From the accumulated data, the analysis system 10 will determine the signed average value corresponding to the peak correlation between the pre-amplified signal and the NOISE2 signal. The delay time associated with that signed average value is used to calculate the distance from the acoustic center of the transducer 6 to the microphone 22. Where the delay time is to be manually adjusted, the signed average value corresponding to the peak correlation may be obtained through a method of manual metering. For example, the operator can adjust the delay time until a peak value is displayed on a meter (not shown), indicating that the delay time of peak correlation has been obtained. Providing a manual metering adjustment for the delay time is well known in the art, and will not be discussed in detail herein.

Following the comparison of the pre-amplified signal and the NOISE2 signal of step 120, the analysis system 10 records the signed average value and its associated delay time in the memory 50 at step 122. The analysis system 10 begins the process of recording signed average values for a series of delay times in steps 124 and 126. At step 124, the determination is made whether a predetermined number of signed average values and associated delay times have been recorded. If the number has not been reached, the delay time of the NOISE2 signal is incrementally stepped at step 126 so that at steps 120 and 122, a new signed average value can be generated and recorded for the new delay time. The direction in which the delay time is stepped will be determined by the initial delay time of the NOISE2. That is, in the case where the initial delay is greater than the approximate time-of-flight, the delay time should be stepped downward to incrementally reduce the delay time with each successive step. On the other hand, if the initial delay time of the noise signal 2 is less than the approximate time-of-flight, the delay time should be incrementally increased with each successive step. In the present example, where the initial delay time of the NOISE2 signal is the sum of the approximate time-of-flight and 1.5 waveperiods at the $f_M$, the delay time will be incrementally reduced. The process of incrementally stepping the delay time, and generating and recording a signed average value for each new delay time, repeats until the number of signed average values reaches the predetermined number.

Determining the predetermined number of signed average values that the analysis system will generate and record, as well as determining the increment by which the delay time is stepped, depend on a variety of factors. One factor that should be considered is the $f_M$. Lower frequencies, which have longer wavelengths, require larger increments in order for the distance measurement to be accurate, and for the measurement to finish within a reasonable time frame. Consequently, the analysis system 10 is preferably programmed with incremental delay times that are related to the $f_M$. The number of signed average values that are generated should take into consideration the number that will provide an accurate measurement without taking an unduly long time. As an example, the analysis system 10 may be programmed to step the delay time of the NOISE2 signal in increments of $\frac{1}{24}T_{fM}$, for 96 successive delay steps. As a result, the signed average value will be generated and recorded for time span of $4T_{fM}$. It has been found that this time span is sufficient to produce accurate results while finishing within a reasonable time frame.

As a person of ordinary skill in the art will appreciate, the specific increments of delay times, whether the successive incremental steps decrease or increase the delay time, or the number of incremental delay steps taken, are details that may be modified, but nevertheless remain within the scope of the present invention.

After a sufficient number of signed average values have been generated and recorded through steps 120–126, the analysis system 10, in step 130, will evaluate the recorded signed average values for the one corresponding to the peak correlation between the pre-amplified signal and the NOISE2 signal. The analysis system 10 begins with the signed average value associated with the lowest delay time and proceeds to each successive increasing delay time. As mentioned previously, the signed average value represents the magnitude of correlation between the two signals. Consequently, the delay time associated with the signed average value determined to be the peak correlation is the time for a stimulus signal provided to the electro-acoustic system 2 to be reproduced by the transducer 6 and detected at the point of measurement. In step 132, the physical distance between these two points is calculated by the analysis system 10 based on this delay time.

In addition to calculating the physical distance from the acoustic center of the transducer 6 and the point of measurement, in step 134, the polarity of the transducer 6, with respect to the stimulus signal, may be determined by the sign of the signed average value that was determined to be the peak correlation. A positive average value indicates that the transducer 6 is connected to the power amplifier 4 to generate audio signals having the same polarity as the stimulus signal. Conversely, a negative average value indicates that the polarity is opposite of the stimulus signal.

In step 136, the resulting distance value and polarity of the transducer 6 are provided by the microprocessor 12 to a conventional display driver 52 for displaying the results on a display 54. The process of measuring the distance from the acoustic center of a transducer at a particular frequency to a point of measurement ends at step 140.

A method that may be used to perform step 130 of FIG. 2 to determine which of the recorded signed average values corresponds to the peak correlation is described in detail in the flowchart shown in FIG. 3. At a start 160, a sufficient number of signed average values and associated delay times have been recorded. In evaluating the recorded signed average values, the analysis system 10, in step 162, identifies a first peak average value exceeding a threshold value. The threshold value should be high enough to prevent the analysis system 10 from selecting a minor peak value as the first peak average value, while low enough to ensure that a peak average value will be detected. The value of the threshold voltage will be determined by the desired sensitivity of the analysis system 10.

In step 164, the analysis system 10 further identifies a second peak average value exceeding the threshold value, but having an opposite sign of the first peak average value. That is, a peak average value having the opposite polarity of the first peak average value. The magnitude of the first and second peak average values will be used by the analysis system 10 to determine the peak average value corresponding to the peak correlation of the audio signal produced by the transducer 6 and the NOISE2 signal.

At step 166, the determination is made whether the $f_M$ is greater than or equal to 800 Hz. It has been determined through experimentation that the following algorithm can be used to accurately determine the signed average value corresponding to the peak correlation. In the case where the $f_M$ is greater than or equal to 800 Hz, another determination is made at step 170 regarding whether the ratio of the first and second peak average values is greater than or equal to 1.8. If so, then the analysis system 10 proceeds to step 172, and determines that the larger of the two peak values corresponds to the peak correlation. Consequently, the associated delay time will be used in step 132 (FIG. 2) to calculate the distance from the acoustic center of the transducer 6 to the point of measurement. However, if the resulting ratio is not greater than or equal to 1.8, the analysis system 10 proceeds to step 174, and determines that the peak average value having the lower associated delay time corresponds to the peak correlation. The associated delay time will be subsequently used in step 132 to calculate the distance of the transducer 6.

In the case where the $f_M$ is not greater than or equal to 800 Hz, the analysis system 10 determines at step 176 whether the ratio of the first and second peak average values is greater than or equal to 3.0. As with step 170, if the condition is determined to be true in step 176, the larger of the two peak average values will be selected in step 178 as corresponding to peak correlation, and the associated delay time will be used in step 132 to calculate the distance of the transducer 6. However, if the condition is false, then the peak average value having the lower associated delay time is selected in step 174 to calculate the physical distance instead. The analysis system 10 returns to the step of 132 (FIG. 2) subsequent to finishing at step 180.

As mentioned previously, the particular values used in the algorithm of FIG. 3 are provided for the purposes of illustration. A person of ordinary skill in the art will realize, however, that a method using different ratios could also be used.

Figure 4A:
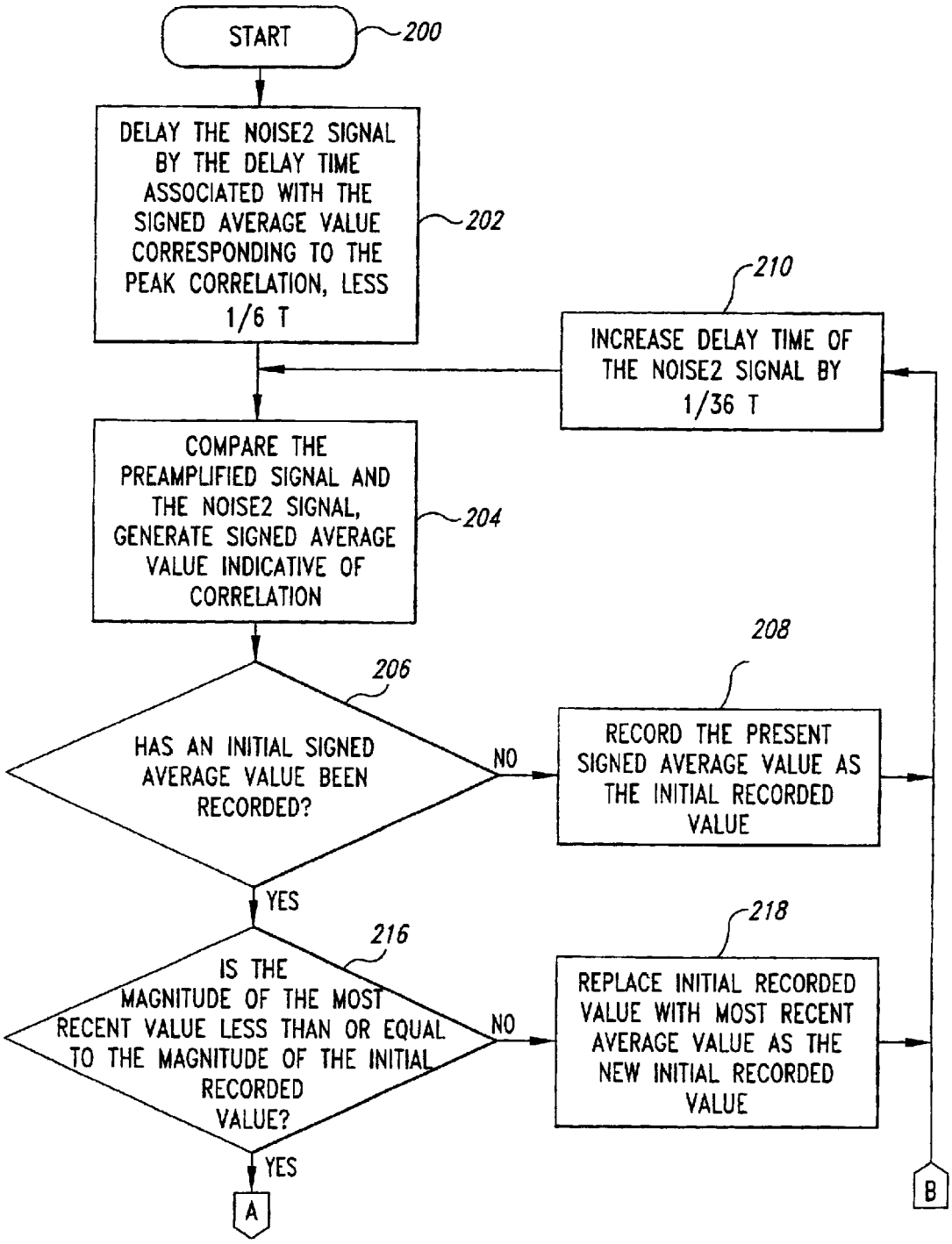
FIGS. 4A–B is a flowchart showing an operation that may be executed in addition to the operation shown in FIGS. 2A–B for more precisely determining the peak correlation according to an embodiment of the present invention.
Figure 4B:
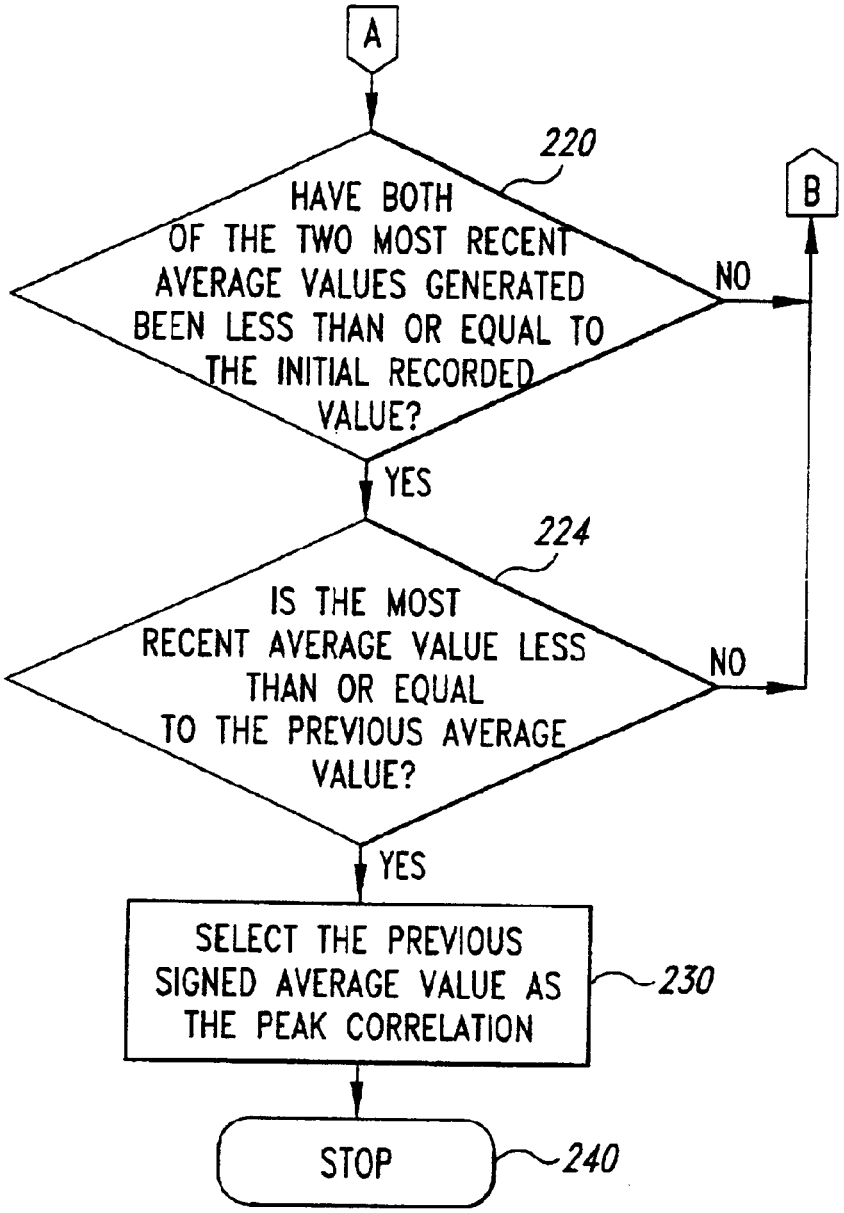

Illustrated in FIG. 4 is a flowchart describing in detail an additional method that may be incorporated into the flow chart of FIG. 2 for more precisely determining the signed average value corresponding to the peak correlation of the pre-amplified signal and the noise signal 2. The steps shown in FIG. 4 can be inserted between steps 130 and 132 of FIG. 2. At a start 200, the analysis system 10 has already evaluated and determined the signed average value corresponding to the peak correlation. A starting point for the precision measurement is selected in step 202. In the present example, subsequent signed average values will be generated for increasing delay times. Thus, a suggested starting point is at the delay value determined in step 130 (FIG. 2), less $\frac{1}{6}T_{fM}$. However, it will be appreciated that the particular starting point may be increased or decreased from the suggested value. In step 204, a signed average value at the starting point is generated. The signed average value is recorded as the initial recorded value at step 208 if it is determined at step 206 that it is the first signed average value that has been generated. Subsequently generated signed average values will be compared to the initial recorded value. Generating a signed average value at step 204 is performed in a manner similar to step 120 of FIG. 2. That is, the filtered analog output of the mixer 40 is sampled by the ADC 46 and resulting digital values are averaged. The output of the mixer 40 was suggested to be sampled 128 times at 20 ms intervals. In comparison to step 120, the number of samples made may be increased and the interval lengthened in step 204 to provide a more accurate signed average value. For example, the output of the mixer 40 may be sampled 256 times at 40 ms intervals. The particular number of samples made, and sampling frequency, will be determined based on factors such as the desired accuracy of the signed average value, the length of test time desired, and the type of stimulus signals used by the analysis system 10. Consequently, other values for the number of samples taken and the sampling rate may be used.

The delay time of the NOISE2 signal is incrementally stepped in step 210, and another signed average value is generated. As an example, the analysis system 10 may be programmed to increase the delay time of the NOISE2 signal in increments of $\frac{1}{36}T_{fM}$. Since the initial recorded value was already recorded in step 208, the determination of step 216 compares the magnitude of the most recent signed average value with the magnitude of the initial recorded value. If the magnitude of the most recent average value is greater than the initial recorded value, then it will replace the previous initial recorded value in step 218, and will be subsequently used as the new initial recorded value. As illustrated in FIG. 4, the analysis system will continue to incrementally step the delay time of the NOISE2 signal and generate a new signed average value through steps 204–210, until the maximum value of the average value corresponding to the peak correlation between the pre-amplified signal and the NOISE2 signal has been determined.

When the magnitude of the most recent average value is finally found to be less than or equal to the initial recorded value of step 218, a determination at step 220 is made as to whether the two most recent average values generated have been both less than or equal to the initial recorded value. If there has been only one occurrence of the average value being less than the initial recorded value, the delay time is again incremented and another signed average value is generated. However, if the two most recent numbers have both been less than or equal to the initial recorded value, the two numbers are then compared to each other at step 224. If the two numbers, with respect to each other, continue to exhibit a diminishing trend, the determination of step 224 is true, and the first of the two most recent average values generated is selected as the signed average value corresponding to peak correlation between the pre-amplified signal and the NOISE2 signal.

The determinations made at steps 220 and 224 are a means of ensuring that the first average value determined to be less than or equal to the initial recorded value is not simply a diminishing fluctuation, but is truly indicative of the first measurement point at, or just slightly past, the peak signed average value corresponding to peak correlation. The analysis system 10 returns to step 132 (FIG. 2) and completes the measurement at previously described.

From the foregoing it will be appreciated that, although specific embodiments of the invention have been described herein for purposes of illustration, various modifications may be made without deviating from the spirit and scope of the invention. For example, and as mentioned previously, the particular values provided herein have been by way of example. However, the particular sampling rates, number of samples taken, and starting points, among other things, may be selected according to the desired functionality of the analysis system 10, and do not necessarily need to be identically reproduced as described herein. Accordingly, the invention is not limited except as by the appended claims.

What is claimed is:

1. A method of measuring a system delay time between when a stimulus signal is applied to an input of an electro-acoustic system having at least one acoustic transducer and when a resulting audio signal produced by the at least one acoustic transducer in response to the stimulus signal is detected at a point of measurement, the method comprising:

generating a first signal having a repeatable sequence;

coupling the first signal to the electronic input of the electro-acoustic system as the stimulus signal, the acoustic transducer generating a resulting audio signal in response;

generating a second signal at an initial delay time subsequent to generating the first signal, the second signal having the repeatable sequence of the first signal;

converting the resulting audio signal detected at the point of measurement to a corresponding electronic signal;

comparing the corresponding electronic signal and the second signal for a plurality of delay times beginning with the initial delay time;

generating and recording for the plurality of delay times a corresponding plurality of signed correlation values having magnitudes indicative of the correlation between the corresponding electronic signal and the second signal at the respective delay time;

evaluating the plurality of correlation values for a peak correlation value corresponding to the peak correlation between the corresponding electronic signal and the second signal; and selecting the delay time associated with the peak correlation value as the system delay time.

2. The method of claim 1 wherein the first and second signals comprise pseudo-random pink noise signals.

3. The method of claim 1 wherein generating the first and second signals comprise generating the first and second signals using separate signal sources.

4. The method of claim 1 wherein the first signal comprises live or recorded music.

5. The method of claim 1, further comprising calculating the distance from the acoustic center of the acoustic transducer to the point of measurement from the system delay time.

6. The method of claim 1, further comprising:

selecting a measurement frequency at which to measure the time between applying the stimulus signal and detecting the resulting audio signal; and attenuating frequency components of the corresponding electronic signal and the second signal that are substantially greater than and less than the measurement frequency.

7. The method of claim 6 wherein selecting a measurement frequency comprises determining an energy center frequency for the acoustic transducer at which the total energy produced by the acoustic transducer for frequencies greater than the energy center frequency is substantially equal to the total energy produced by the acoustic transducer for frequencies less than the energy center frequency over a 20 hertz to 20,000 hertz frequency spectrum.

8. The method of claim 6 wherein the plurality of delay times for which a correlation value is generated comprises 96 delay times at increments of ($\frac{1}{24}\times T$), T being defined as the period of a wavelength at the measurement frequency.

9. The method of claim 6 wherein evaluating the plurality of recorded correlation values for a peak correlation value comprises:

determining a first peak correlation value having a first magnitude greater than a threshold value and further having a first polarity;

determining a second peak correlation value having a second magnitude greater than the threshold value, and further having a second polarity opposite of the first polarity;

selecting the greater of the first and second magnitudes as the peak correlation value when the measurement frequency is greater than or equal to 800 hertz and the ratio of the first and second magnitudes is greater than or equal to 1.8;

selecting the greater of the first and second magnitudes as the peak correlation value when the measurement frequency is less than 800 hertz and the ratio of the first and second magnitudes is greater than or equal to 3.0; and selecting from the first and second peak correlation values the one having the lower associated delay time as the peak correlation value when the measurement frequency is greater than or equal to 800 hertz and the ratio of the first and second magnitudes is less than 1.8, and when the measurement frequency less than 800 hertz and the ratio of the first and second magnitudes is less than 3.0.

10. The method of claim 1, further comprising determining a polarity of the acoustic transducer with respect to the first signal from the sign of the correlation signal.

11. The method of claim 1, further comprising determining an approximate time-of-flight for an impulse signal applied to the input of the electro-acoustic system to be reproduced by the acoustic transducer and detected at the point of measurement, the approximate time used to determine the initial delay time.

12. The method of claim 11 wherein determining an approximate time-of-flight comprises measuring the time for a sine ping applied to the input of the electro-acoustic system and reproduced by the acoustic transducer to be detected at the point of measurement.

13. The method of claim 11 wherein the initial delay time is greater than the approximate time-of-flight and the plurality of delay times for which the correlation values are generated is incrementally decreased from the initial delay time.

14. The method of claim 13, further comprising selecting a measurement frequency at which to measure the time between applying the stimulus signal and detecting the resulting audio signal, and wherein the initial delay time is greater than the approximate time-of-flight by ($1.5\times T$), T being defined as the period of a wavelength at the measurement frequency.

15. The method of claim 6, further comprising:

setting the delay time of the second signal to a first delay time that is less than the system delay time;

generating a signed correlation value for the first delay time;

incrementing the delay time of the second signal and generating a new signed correlation value until there are two occurrences of the magnitude of the new signed correlation value being less than the previous signed correlation value; and selecting the delay time associated with the previous signed correlation value as the system delay time.

16. The method of claim 15 wherein setting the delay time comprises setting the first delay time to be equal to the system delay time less ($\frac{1}{6}\times T$), T being defined as the period of a wavelength at the measurement frequency.

17. The method of claim 15 wherein incrementing the delay time comprises incrementing the delay time in increments of ($\frac{1}{36}\times T$), T being defined as the period of a wavelength at the measurement frequency.

18. The method of claim 15 wherein generating a new signed correlation value comprises:

sampling the value of an output signal of a mixer receiving the corresponding electronic signal and the second signal 256 times at 40 millisecond intervals;

converting each sampled value to a corresponding digital value; and averaging the corresponding digital values.

19. The method of claim 1 wherein delay times of the plurality are automatically generated.

20. The method of claim 1 wherein generating a correlation value for each of the plurality of delay times comprises:

sampling the value of an output signal of a mixer receiving the corresponding electronic signal and the second signal a predetermined number of times at an interval;

converting each sampled value to a corresponding digital value; and averaging the corresponding digital values.

21. The method of claim 20 wherein the predetermined number of times is 128 and the interval is 20 milliseconds.

22. A method of measuring a time-of-flight for an audio signal generated by a selected one of a plurality of acoustic transducers of an electro-acoustic system to reach a W point of measurement, comprising:

generating a first pseudo-random noise signal having a repeatable sequence as the stimulus signal applied to the electro-acoustic system;

generating a second pseudo-random noise signal at a source delay time subsequent to generating the first noise signal, the second noise signal having the repeatable sequence of the first noise signal;

converting an audio signal generated by the selected acoustic transducer in response to the stimulus signal into an electronic signal when the audio signal is detected at the point of measurement;

comparing the electronic signal and the second noise signal for a plurality of delay times beginning with the source delay time;

generating and recording for the plurality of delay times a corresponding plurality of signed average values having magnitudes indicative of the correlation between the electronic signal and the second noise signal;

evaluating the plurality of signed average values for a peak correlation value corresponding to the maximum correlation between the electronic signal and the second noise signal; and selecting the delay time associated with the peak correlation value as the time-of-flight.

23. The method of claim 22 wherein generating the first and second signals comprise generating the first and second signals using separate signal sources.

24. The method of claim 22 wherein delay times of the plurality are automatically generated.

25. The method of claim 22, further comprising calculating the distance from an acoustic center of the acoustic transducer to the point of measurement from the time-of-flight.

26. The method of claim 22, further comprising:

selecting a measurement frequency at which to measure the time-of-flight; and attenuating frequency components of the corresponding electronic signal and the second noise signal that are substantially greater than and less than the measurement frequency.

27. The method of claim 26 wherein selecting a measurement frequency comprises determining an energy center frequency for the acoustic transducer at which the total energy produced by the acoustic transducer for frequencies greater than the energy center frequency is substantially equal to the total energy produced by the acoustic transducer for frequencies less than the energy center frequency over a 20 hertz to 20,000 hertz frequency spectrum.

28. The method of claim 26 wherein the plurality of delay times for which the signed average values are generated comprises 96; delay times at increments of ($\frac{1}{24}\times T$), T being defined as the period of a wavelength at the measurement frequency.

29. The method of claim 26 wherein evaluating the plurality of signed average values for the peak correlation value comprises:

determining a first peak correlation value having a first magnitude greater than a threshold value and further having a first polarity;

determining a second peak correlation value having a second magnitude greater than the threshold value, and further having a second polarity opposite of the first polarity;

selecting the greater of the first and second magnitudes as the peak correlation value when the measurement frequency is greater than or equal to 800 hertz and the ratio of the first and second magnitudes is greater than or equal to 1.8;

selecting the greater of the first and second magnitudes as the peak correlation value when the measurement frequency is less than 800 hertz and the ratio of the first and second magnitudes is greater than or equal to 3.0; and selecting from the first and second peak correlation values the one having the lower associated delay time as the peak correlation value when the measurement frequency is greater than or equal to 800 hertz and the ratio of the first and second magnitudes is less than 1.8, and when the measurement frequency less than 800 hertz and the ratio of the first and second magnitudes is less than 3.0.

30. The method of claim 26, further comprising:

setting the delay time of the second noise signal to a first delay time that is less than the time-of-flight;

generating a signed average value for the first delay time;

incrementing the delay time of the second noise signal and generating a new signed average value until there are two occurrences of the magnitude of the new signed average value being less than the previous signed average value; and selecting the delay time associated with the previous signed average value as the time-of-flight.

31. The method of claim 30 wherein setting the delay time comprises setting the first delay time to be equal to the time-of-flight less ($\frac{1}{6}\times T$), T being defined as the period of a wavelength at the measurement frequency.

32. The method of claim 30 wherein incrementing the delay time comprises incrementing the delay time in increments of ($\frac{1}{36}\times T$), T being defined as the period of a wavelength at the measurement frequency.

33. The method of claim 30 wherein generating a new signed average value comprises:

sampling the signed value of an output signal of a mixer receiving the corresponding electronic signal and the second noise signal 256 times at 40 millisecond intervals; and averaging the corresponding digital values.

34. The method of claim 22, further comprising determining a polarity of the acoustic transducer with respect to the first noise signal from the sign of the peak correlation value.

35. The method of claim 22, further comprising determining an approximate time-of-flight for an impulse signal applied to the electro-acoustic system to be reproduced by the acoustic transducer and detected at the point of measurement, the approximate time-of-flight used to determine the source delay time.

36. The method of claim 35 wherein determining an approximate time-of-flight comprises measuring the time for a sine ping applied to the electro-acoustic system and reproduced by the acoustic transducer to be detected at the point of measurement.

37. The method of claim 35 wherein the source delay time is greater than the approximate time-of-flight and the plurality of delay times for which the signed average values are generated is incrementally decreased from the source delay time.

38. The method of claim 37, further comprising selecting a measurement frequency at which to measure the time-of-flight, and the initial delay time is greater than the approximate time-of-flight by (1.5×T), T being defined as the period of a wavelength at the measurement frequency.

39. The method of claim 37 wherein generating a signed average value for each of the plurality of delay times comprises:

sampling the signed value of an output signal of a mixer receiving the corresponding electronic signal and the second signal a predetermined number of times at an interval;

converting each sampled signed value to a corresponding digital value; and averaging the corresponding digital values.

40. The method of claim 39 wherein the predetermined number of times is 128 and the interval is 20 milliseconds.

41. A system for measuring a time delay between when a stimulus signal is applied to an input of an electro-acoustic system having at least one acoustic transducer and when a resulting audio signal produced by the at least one acoustic transducer in response to the stimulus signal is detected at a point of measurement, the system comprising:

a signal generator to generate first and second signals at first and second signal outputs of the signal generator, respectively, the first signal having a sequence and being applied through the first signal output to the electronic input of the electro-acoustic system as the stimulus signal, the second signal having the sequence of the first signal and being delayed with respect to the first signal by an adjustable delay time determined by the value of a delay control signal;

a microphone acoustically coupled to the at least one acoustic transducer of the electro-acoustic system and generating at a microphone output a resulting output signal corresponding to the resulting acoustic signal;

a mixer circuit coupled to the microphone output and the second signal output to receive the resulting output signal and second pseudo-random noise signal, respectively, the mixer circuit providing at a mixer output a mixer output signal having a magnitude indicative of a predetermined relationship between the resulting output signal and the second signal;

an analog-to-digital converter having an input coupled to the mixer output, the analog-to-digital converter generating at a converter output digital words corresponding to the magnitude of the mixer output signal applied to its input;

a memory for recording the digital words;

a display for displaying information resulting from the measurement; and a microprocessor coupled to the signal generator for generating the delay control signal, the analog-to-digital converter for receiving the digital words corresponding to the magnitude of the mixer output signal, the memory for recording the digital words, and the display for providing information related the measurement to be displayed, the microprocessor measuring the time delay by:

initiating the signal generator to generate the first signal;

adjusting the delay control signal provided to the delay circuit to delay the second signal with respect to the first signal for a plurality of delay times;

recording for each of the plurality of delay times a digital word generated by the analog-to-digital converter;

evaluating the digital words for a selected digital word corresponding to the peak of the predetermined relationship between the resulting output signal and second signal; and causing the display to provide visual information related to the selected digital word.

42. The system of claim 41 wherein the signal generator comprises a first pseudo-random noise generator to generate a first pseudo-random noise signal, and a second pseudo-random noise generator to generate a second pseudo-random noise signal.

43. The system of claim 42 wherein the frequency spectrum of the first and second pseudo-random noise signals have equal energy in each octave.

44. The system of claim 41 wherein the signal generator is adapted to generate a first signal comprising live or recorded music.

45. The system of claim 41 wherein the predetermined relationship between resulting output signal and the second signal comprises a correlation between resulting output signal and the second signal.

46. The system of claim 41, further comprising:

an oscillator coupled to the microprocessor and generating at an oscillator output a frequency control signal having a primary frequency component determined by the value of an oscillator frequency control signal provided by the microprocessor; and first and second band-pass filters each attenuating frequency components of a signal applied to an input that are significantly greater than and less than a band-pass frequency corresponding to the value of the frequency control signal applied to a frequency control input by the oscillator, the first band-pass filter electrically coupled between the microphone output and the mixer circuit, and the second band-pass filter electrically coupled between the delay circuit output and the mixer circuit.

47. The system of claim 46 wherein the microprocessor determines the value of the oscillator frequency control signal by selecting an energy center frequency for the at least one acoustic transducer at which the total energy produced by the at least one acoustic transducer for frequencies greater than the energy center frequency is substantially equal to the total energy produced by the at least one acoustic transducer for frequencies less than the energy center frequency.

48. The system of claim 41, further comprising a low-pass filter electrically coupled between the mixer output and the input of the analog-to-digital converter to limit the intensity of high frequency components of the mixer output signal.

49. The system of claim 41 wherein the mixer circuit comprises a four quadrant multiplier.

50. The system of claim 41 wherein the microprocessor is programmed to adjust the delay control signal automatically.

51. An analysis system for measuring a system delay time between when a stimulus signal is applied to an input of an electro-acoustic system having at least one acoustic transducer and when a resulting audio signal produced by the at least one acoustic transducer in response to the stimulus signal is detected at a point of measurement, the method comprising:

first signal generator means for generating a first signal having a repeatable sequence coupled to the electronic input to provide the first signal as the stimulus signal;

second signal generator means for generating a second signal at an initial delay time subsequent to generating the first signal, the second signal having the repeatable sequence of the first signal;

microphone means for converting the resulting audio signal detected at the point of measurement to a corresponding electronic signal, the microphone means acoustically coupled to the acoustic transducer;

comparison circuit means for comparing the corresponding electronic signal and the second signal for a plurality of delay times beginning with the initial delay time;

converter circuit means for generating for the plurality of delay times a corresponding plurality of signed correlation values having magnitudes indicative of the correlation between the corresponding electronic signal and the second signal at the respective delay time;

memory means for storing the plurality of signed correlation values and the corresponding plurality of delay times;

microprocessor means for evaluating the plurality of correlation values for a peak correlation value corresponding to the peak correlation between the corresponding electronic signal and the second signal, the microprocessor means further selecting the delay time associated with the peak correlation value as the system delay time; and display means coupled to the microprocessor means for displaying information generated by the microprocessor means.

52. The analysis system of claim 51 wherein the first and second signal generator means comprise pseudo-random pink noise generator means.

53. The analysis system of claim 51 wherein the first signal generator is adapted to generate a first signal comprising live or recorded music.

54. The analysis system of claim 51 wherein the microprocessor means further configured to calculate the distance from the acoustic center of the acoustic transducer to the point of measurement from the system delay time.

55. The analysis system of claim 51, further comprising:

a measurement frequency selection means coupled to the microprocessor means for providing a frequency control signal having a primary frequency component equal to a measurement frequency determined by the microprocessor means; and a first and second filter means for attenuating frequency components of the corresponding electronic signal and the second signal, respectively, that are substantially greater than and less than the measurement frequency.

56. The analysis system of claim 55 wherein the microprocessor means selects as the measurement frequency an energy center frequency at which the total energy produced by the acoustic transducer for frequencies greater than the energy center frequency is substantially equal to the total energy produced by the acoustic transducer for frequencies less than the energy center frequency over a 20 hertz to 20,000 hertz frequency spectrum.

57. The analysis system of claim 51 wherein the comparison circuit means comprises a four quadrant multiplier.

58. The analysis system of claim 51 wherein the microprocessor means is programmed to select the delay time automatically.

59. The analysis system of claim 51, further comprising a low-pass filter means coupled between the comparison circuit means and converter circuit means for limiting the intensity of high frequency components of the correlation signal.

60. A system for measuring a time delay between when a stimulus signal is applied to an input of an electro-acoustic system having at least one acoustic transducer and when a resulting audio signal produced by the at least one acoustic transducer in response to the stimulus signal is detected at a point of measurement, the system comprising:

a first pseudo-random noise generator generating at a first noise output a first pseudo-random noise signal having a repeatable sequence, the first pseudo-random noise signal applied through the first noise output to the electronic input of the electro-acoustic system as the stimulus signal;

a microphone acoustically coupled to the at least one acoustic transducer of the electro-acoustic system and generating at a microphone output a resulting output signal corresponding to the resulting acoustic signal;

a second pseudo-random noise generator generating at a second noise output a second pseudo-random noise signal having the repeatable sequence of the first pseudo random noise signal, the second pseudo-random noise signal being delayed with respect to the first pseudo-random noise signal by a delay time determined by the value of a delay control signal;

a comparison circuit coupled to the microphone output and the second noise output to compare the resulting output signal and the second pseudo-random noise signal, the comparison circuit providing at a comparison circuit output digital words corresponding to the magnitude of correlation between the resulting output signal and the second pseudo-random noise signal;

a memory circuit for storing the digital words provided by the comparison circuit;

a display for displaying information resulting from the measurement; and a microprocessor coupled to the first and second pseudo-random noise generators for initiating the first pseudo-random noise signal and initiating the second pseudo-random at the delay time, the comparison circuit output for receiving the digital words, the memory circuit for providing the digital words for storage, and the display for providing data related to the measurement to be displayed, the microprocessor measuring the time delay by:

initiating the first pseudo-random noise generator to generate the first pseudo-random noise signal, and initiating the second pseudo-random noise generator at an initial delay time thereafter to generate the second pseudo-random noise signal;

providing the delay control signal to the second pseudo-random noise generator to adjust the delay value for a plurality of delay times;

storing for each of the plurality of delay times a digital word provided by the comparison circuit;

evaluating the digital words for a selected digital word corresponding to the peak correlation of the resulting output signal and second pseudo-random noise signal; and causing the display to provide visual information related to the selected digital word.

61. The system of claim 60, further comprising:

an oscillator coupled to the microprocessor and generating at an oscillator output a frequency control signal having a primary frequency component determined by the value of an oscillator frequency control signal provided by the microprocessor; and first and second band-pass filters each attenuating frequency components of a signal applied to an input that are significantly greater than and less than a band-pass frequency corresponding to the value of the frequency control signal applied to a frequency control input by the oscillator, the first band-pass filter electrically coupled between the microphone output and the comparison circuit to attenuate the resulting output signal, and the second band-pass filter electrically coupled between the second noise output and the comparison circuit to attenuate the second pseudo-random noise signal.

62. The system of claim 61 wherein the microprocessor determines the value of the oscillator frequency control signal by selecting an energy center frequency for the at least one acoustic transducer at which the total energy produced by the at least one acoustic transducer for frequencies greater than the energy center frequency is substantially equal to the total energy produced by the at least one acoustic transducer for frequencies less than the energy center frequency.

63. The system of claim 60 wherein the comparison circuit comprises:

a mixer circuit coupled to the microphone output and the second noise output to provide at a mixer output a correlation signal having a magnitude corresponding to the correlation between the resulting output signal and the second pseudo-random noise signal; and an analog-to-digital converter having an input coupled to the mixer output to sample the magnitude of the correlation signal and a converter output for providing the digital words.

64. The system of claim 63 wherein the comparison circuit further comprises a low-pass filter electrically coupled between the mixer output and the input of the analog-to-digital converter to limit the intensity of high frequency components of the correlation signal.

65. The system of claim 63 wherein the mixer circuit comprises a four quadrant multiplier.

66. The system of claim 60 wherein the microprocessor is programmed to provide the delay control signal automatically.

67. The system of claim 60 wherein the frequency spectrum of the first and second pseudo-random noise signals have equal energy in each octave.

* * * * *

UNITED STATES PATENT AND TRADEMARK OFFICE

CERTIFICATE OF CORRECTION

PATENT NO. : 6,970,568 B1
APPLICATION NO. : 09/406203
DATED : November 29, 2005
INVENTOR(S) : Dwight H. Freeman and Dennis Lynn Griffiths It is certified that error appears in the above-identified patent and that said Letters Patent is hereby corrected as shown below:

| Column, Line | Reads | Should Read |
|---|---|---|
| Column 3, Line 35 | "of a electro-acoustic" | --of an electro-acoustic-- |
| Column 6, Line 43 | "the desired $f_M$ . may be" | --the desired $f_M$ may be-- |
| Column 8, Line 10 | "having its $_C$ equal to" | --having its $f_C$ equal to-- |
| Column 8, Line 34 | "converting to digital values" | --converted to digital values-- |
| Column 8, Line 51 | "making **128** samples at **20** ms" | --making 128 samples at 20 ms-- |
| Column 8, Line 55 | "and the samples" | --and the sample-- |
| Column 9, Line 59 | "recorded for time span of" | --recorded for a time span of-- |
| Column 14, Line 6 | "frequency less than" | --frequency is less than-- |
| Column 15, Line 14 | "to reach a W point" | --to reach a point-- |
| Column 15, Line 43 | "signals comprise" | --signals comprises-- |
| Column 16, Line 1 | "comprises 96; delay times" | --comprises 96 delay times-- |
| Column 16, Line 30 | "frequency less than" | --frequency is less than-- |
| Column 18, Lines 32-33 | "between resulting output signal and the second signal comprises a correlation between resulting output signal" | --between the resulting output signal and the second signal comprises a correlation between the resulting output signal-- |
| Column 19, Line 50 | "means further configured" | --means is further configured-- |

UNITED STATES PATENT AND TRADEMARK OFFICE

CERTIFICATE OF CORRECTION

PATENT NO. : 6,970,568 B1
APPLICATION NO. : 09/406203
DATED : November 29, 2005
INVENTOR(S) : Dwight H. Freeman and Dennis Lynn Griffiths It is certified that error appears in the above-identified patent and that said Letters Patent is hereby corrected as shown below:

| Column, Line | Reads | Should Read |
|---|---|---|
| Column 20, Line 52 | "random at the delay time," | --random noise signal at the delay time,-- |

Signed and Sealed this

Twenty-seventh Day of November, 2007

JON W. DUDAS
*Director of the United States Patent and Trademark Office*